US012767297B1

(12) United States Patent
Downey et al.

(10) Patent No.: US 12,767,297 B1
(45) Date of Patent: Oct. 20, 2026

(54) SUBMERSIBLE THRUST VECTORING APPARATUS

(71) Applicant: The United States of America, as represented by the Secretary of the Navy, Arlington, VA (US)

(72) Inventors: Isaac Downey, Middletown, MD (US); Benjamin Gordon, Rockville, MD (US); Don Pfitsch, Kensington, MD (US); Joseph Buto, Columbia, MD (US)

(73) Assignee: The United States of America, as represented by the Secretary of the Navy, Washington, DC (US)

( * ) Notice: Subject to any disclaimer, the term of this patent is extended or adjusted under 35 U.S.C. 154(b) by 246 days.

(21) Appl. No.: 18/757,761

(22) Filed: Jun. 28, 2024

(51) Int. Cl.
*B63G 8/20* (2006.01)

(52) U.S. Cl.
CPC ..... *B63G 8/20* (2013.01)

(58) Field of Classification Search
CPC ... B63G 8/00; B63G 8/08; B63G 8/14; B63G 8/20
USPC .... 114/312, 313, 330, 337, 338; 440/38, 40, 440/42, 49, 53, 57
See application file for complete search history.

(56) References Cited

U.S. PATENT DOCUMENTS

| | | | | |
|---|---|---|---|---|
| 7,290,496 | B2 * | 11/2007 | Asfar | B63G 8/001 114/333 |
| 7,666,040 | B2 | 2/2010 | Arvidsson | |
| 8,418,642 | B2 | 4/2013 | Vosburgh | |
| 9,096,106 | B2 * | 8/2015 | Hanson | B64U 10/25 |
| 9,669,904 | B2 * | 6/2017 | Hanson | B60F 5/00 |
| 10,331,131 | B2 * | 6/2019 | Hanson | G05D 1/0088 |
| 2012/0289103 | A1 | 11/2012 | Hudson | |
| 2019/0256181 | A1 | 8/2019 | Valsvik | |

FOREIGN PATENT DOCUMENTS

| | | | |
|---|---|---|---|
| CN | 107161309 | B | 2/2019 |
| CN | 108698677 | B | 6/2021 |
| KR | 101293312 | B1 | 8/2013 |
| KR | 101334566 | B1 | 11/2013 |
| KR | 20160015935 | A | 2/2016 |

* cited by examiner

*Primary Examiner* — Daniel V Venne

(74) *Attorney, Agent, or Firm* — Jesus J. Hernandez; U.S. Department of the Navy, Office of the General Counsel

(57) ABSTRACT

Example embodiments provide a thrust vectoring apparatus. The thrust vectoring apparatus may comprise a swivel plate, a thruster, an actuator unit, a first pushrod, and a second pushrod. The swivel plate may include bearings and be configured to have angular movement about an axis. The thruster may be connected to the swivel plate and configured to move alongside the swivel plate. The first pushrod and the second pushrod may be connected to the bearings and configured to extend in an aft direction or retract in a forward direction in response to an actuated force. The actuator unit may be configured to provide the actuated force to the first pushrod and the second pushrod, which may be connected to the actuator unit. The angular movement of the swivel plate may be in response to the actuated force from at least one of the first pushrod and the second pushrod.

17 Claims, 7 Drawing Sheets

SUBMERSIBLE THRUST VECTORING APPARATUS

STATEMENT OF GOVERNMENT INTEREST

The following description was made in the performance of official duties by employees of the Department of the Navy. The claimed subject matter, encompassing various example embodiments, may be manufactured, used, licensed by or for the United States Government for governmental purposes without the payment of any royalties thereon. Potential licensees may contact the Technology Transfer Office, NAVSEA Naval Surface Warfare Center, Carderock Division, 9500 MacArthur Blvd., West Bethesda, MD 20817, USA.

CROSS-REFERENCE TO RELATED APPLICATIONS

This application claims the priority to U.S. Provisional Application No. 63/656,749 filed Jun. 6, 2024, titled "Compact Submersible Thrust Vectoring System," incorporated herein by reference.

FIELD

The following description relates generally to submersible vehicles.

BACKGROUND

Marine vehicles may rely on actuated control surfaces and/or auxiliary thrusters to provide pitch and heading control. This may include surface and/or submersible vehicles. Actuated control surfaces may have a fixed thruster for forward propulsion. Control surfaces may increase drag and power requirements of a vehicle. Control surfaces may also have limited effectiveness at low speeds. Control surfaces may suffer from stalling at higher angles and speeds, limiting a maximum amount of directional control can be provided to a marine vehicle.

Auxiliary thrusters may be effective at low and zero-speed operations. However, auxiliary thrusters often may have limited functionality during high speed maneuvering. Auxiliary thrusters are typically mounted external to a vehicle's hull, providing increased drag and noise to a vehicle.

SUMMARY

Example embodiments provide a thrust vectoring apparatus. The thrust vectoring apparatus may comprise a swivel plate, a thruster, an actuator unit, a first pushrod, and a second pushrod. The swivel plate may include bearings and be configured to have angular movement about an axis. The thruster may be connected to the swivel plate and configured to move alongside the swivel plate. The first pushrod and the second pushrod may be connected to the bearings and configured to extend in an aft direction or retract in a forward direction in response to an actuated force. The actuator unit may be configured to provide the actuated force to the first pushrod and the second pushrod, which may be connected to the actuator unit. The angular movement of the swivel plate may be in response to the actuated force from at least one of the first pushrod and the second pushrod.

Other features and advantages of the invention will become apparent to those skilled in the art upon examination of the following or upon learning by practice of the invention.

BRIEF DESCRIPTION OF DRAWINGS

The accompanying figures are included to provide a further understanding of example embodiments, and are incorporated in and constitute part of this specification. In the figures.

Figure 1:
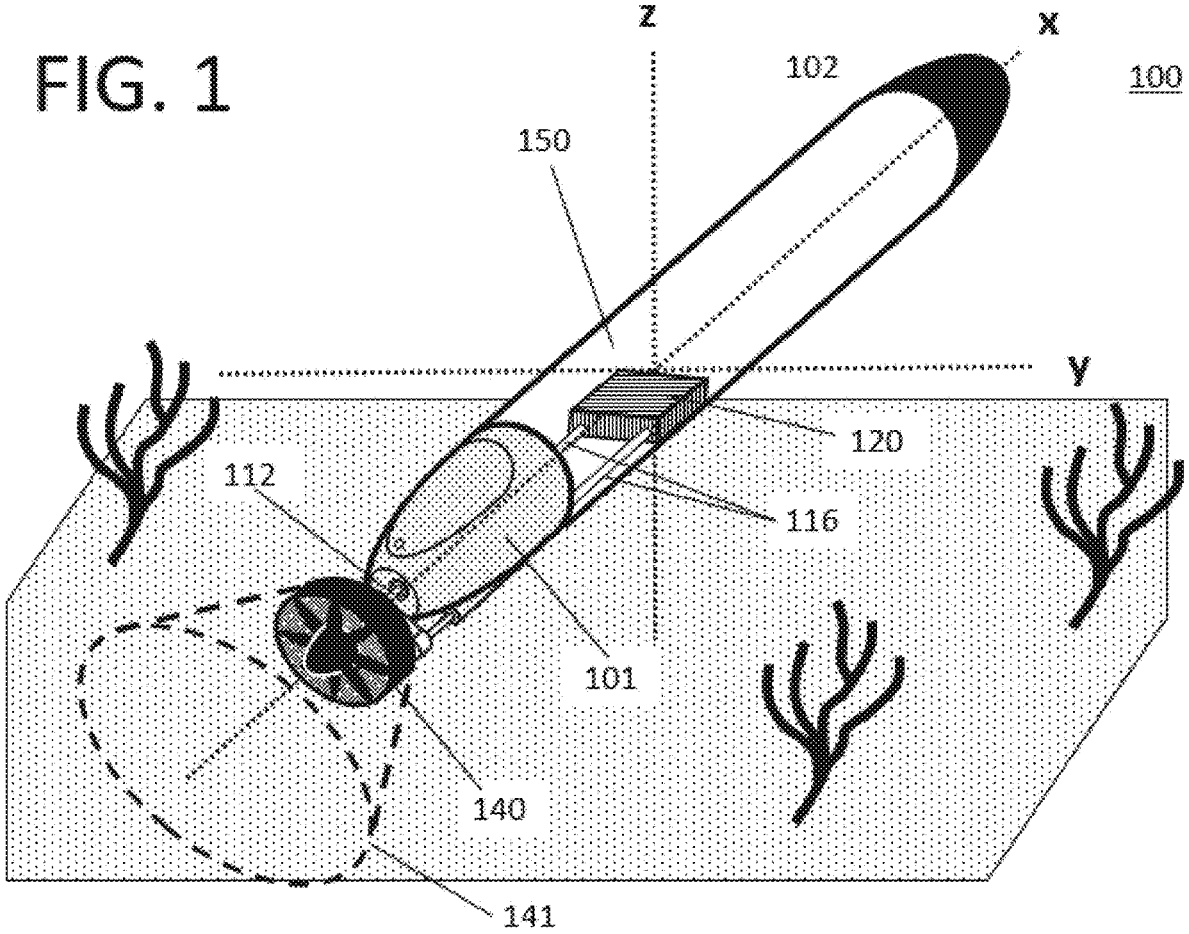
FIG. 1 is an illustration of a thrust vectoring system in a submersible vehicle, according to example embodiments.

In the figures, the leading number of each element corresponds to the figure number in order to facilitate better exposition when discussing a feature in a particular example embodiment. Common features across different figures use the same subsequent digits to maintain consistency.

DETAILED DESCRIPTION

In the following description, for purposes of explanation and not limitation, specific details are set forth such as particular structures, designs, techniques, etc., in order to provide a thorough understanding of the example embodiments. However, it will be apparent to those skilled in the art that the disclosed subject matter may be practiced in other illustrative embodiments that depart from these specific details. In some instances, detailed descriptions of well-known elements and/or method are omitted so as not to obscure the description with unnecessary detail. All principles, aspects, and embodiments, as well as specific examples thereof, are intended to encompass both structural and functional equivalents of the disclosed subject matter. Additionally, it is intended that such equivalents include both currently known equivalents as well as equivalents developed in the future.

The following description refers to a compact submersible thrust vectoring apparatus and system. However, it should be noted that the example embodiments shown and described herein are meant to be illustrative only and not limiting in any way. As such, various modifications will be apparent to those skilled in the art for application to other fields based on technologies other than the above, which may be in various stages of development and intended for future replacement of, or use with, the above described method or apparatus.

The goal of example embodiments is to provide a compact submersible thrust vectoring system in a marine vehicle that is designed to provide pitch and yaw control by directing thrust. The thrust vectoring system may be designed to maximize maneuvering capabilities of a marine vehicle by using a simple and compact mechanism. The marine vehicle may be a small marine vehicle. Alternative embodiments may be in the form of a larger marine vehicle. The marine vehicle may be a submersible vehicle. Alternative embodiments may be in the form of a surface vehicle.

Conventional surface and/or submersible marine vehicles rely on actuated control surfaces and/or auxiliary thrusters to provide pitch and heading control. The actuated control surfaces may have a fixed thruster for forward propulsion, but these may increase drag and power requirements of a vehicle and have limited effectiveness at low speeds. Auxiliary thrusters, in particular, may have limited functionality during high speed maneuvering and may increase drag as a result of being mounted external to a vehicle's hull. Auxiliary thrusters and/or control surfaces significantly increase complexity and cost of a vehicle.

Example embodiments address the shortcomings of conventional surface and/or submersible marine vehicles. Example embodiments provide a thrust vectoring system with significantly simplified pitch and heading control using a marine vehicle's primary thruster to provide directional control. The thrust vectoring system may also eliminate the need for any control surfaces or auxiliary thrusters. This may result in streamlining and simplifying the design, profile, and control scheme of a marine vehicle. For the purposes of explanation, example embodiments will focus on submersible marine vehicles. It is understood that the thrust vectoring system, according to example embodiments, may be implemented in surface marine vehicles.

FIG. 1 is an illustration 100 of a thrust vectoring system in a submersible vehicle according to example embodiments. In this example, a submersible vehicle 102 may comprise a thrust vectoring system 101. The thrust vectoring system 101 may include a thruster 140 providing propulsion to the submersible vehicle 102. The thrust vectoring system 101 may provide an overall range of thrust vectoring capability. The submersible vehicle 102 may be a small submersible vehicle. More particularly, the submersible vehicle 102 may have a diameter of 2 to 30 inches. Is some examples, the submersible vehicle 102 may have a diameter of 2 to 12 inches. In alternative example embodiments, the thrust vectoring system 101 may be incorporated into large submersible vehicles with a diameter greater than 30 inches.

The thruster 140 may be configured to be able to rotate about a connected stern swivel and support rod 112. The stern swivel and support rod 112 acts as structural support and a rotational center for the thruster 140. As a result of the stern swivel and support rod 112, the thruster 140 may be able to provide thrust about an area defined by conical bounding box 141.

The thrust vectoring system 101 may also comprise an actuator unit 120 and a pair of pushrods 116. The actuator unit 120 may reside within a hull housing 150 of the submersible vehicle 102. The hull housing 150 may be a dry housing for use in a marine environment. The actuator unit 120 may be connected to the pair of pushrods 116. The pushrods 120 may traverse the hull housing 150 and the housing of the thrust vectoring system to connect with the thruster 140. An intermediary component with swivel bearings may facilitate a connection between the pushrods 120 and the thruster 140. The intermediary component may be a swivel plate (not shown in FIG.). The swivel plate may translate linear force into angular movement.

The configuration of the thrust vectoring system 101 may provide various unique features for navigating the submersible vehicle 102. The thrust vectoring system 101 may directly adjust the orientation of the thruster 140 anywhere within the conical bounding box 141 when the actuator unit 120 causes the pair of pushrods 116 to move, individually or jointly, in a linear direction. The actuator unit 116 may comprise RC servos and the pushrods 116 may be connected to swivels arranged in off-centered locations relative to the stern swivel and support rod 112. The swivels may be ball bearing swivels. While the actuator unit 120 may cause the pushrods 116 to move in a linear direction, the swivel configuration of the thrust vectoring system 101 may convert the linear movement by the pushrods 116 into an angular orientation of the thruster 140.

The pushrods 116 may be of a flexible constitution. More specifically, during actuation by the actuator unit 120, the pushrods 116 may flex to account for any offset associated with a swinging motion by the thruster 140 to a non-zero angle. The use of flexible pushrods 116 permits simplification of mechanical components in the thrust vectoring system 101. Flexible pushrods 116 allow the actuator unit 120 to be placed in a dry section of the submersible vehicle 102 by sealing the pushrods themselves, discussed further below. The material of the pushrods 166 may vary according the pliability of the material. The material may be a plastic and/or a metal. More specifically, the material may comprise acetyl, stainless steel, bronze, anodized aluminum, and/or nylon. The material may also be wear resistant, particularly for use in a marine environment. The selected pliability of the pushrods 116 may correspond to the size of the submersible vehicle 102.

The configuration of thrust vectoring system 101 may reduce complexity and cost. More specifically, the configuration eliminates the need for the control surfaces and/or or the auxiliary thrusters of conventional submersible vehicles. The configuration of the thrust vectoring system 101 may provide simultaneous pitch and heading control. The thrust vectoring system 101 permits pitch and heading control during both high and low speed operations. Furthermore, the thrust vectoring system 101 permits use of the largest possible thruster 140 within bounds defined by a profile of the submersible vehicle 102.

The configuration of thrust vectoring system 101 may provide control redundancy to prevent a rise or dive casualty from occurring based on the makeup of the actuator unit 120. For example, the actuator unit 120 may comprise two separate servo units controlling the orientation of the thruster 140. The actuator unit 120 may prevent the thruster 140 from being jammed in a nose up or down orientation through the use of the use of the pushrods 116. Similar thrust vectoring designs as the example embodiments described may not be practical with conventional approaches and at the described scale due to actuation requirements and mechanical complexity.

Figure 2A:
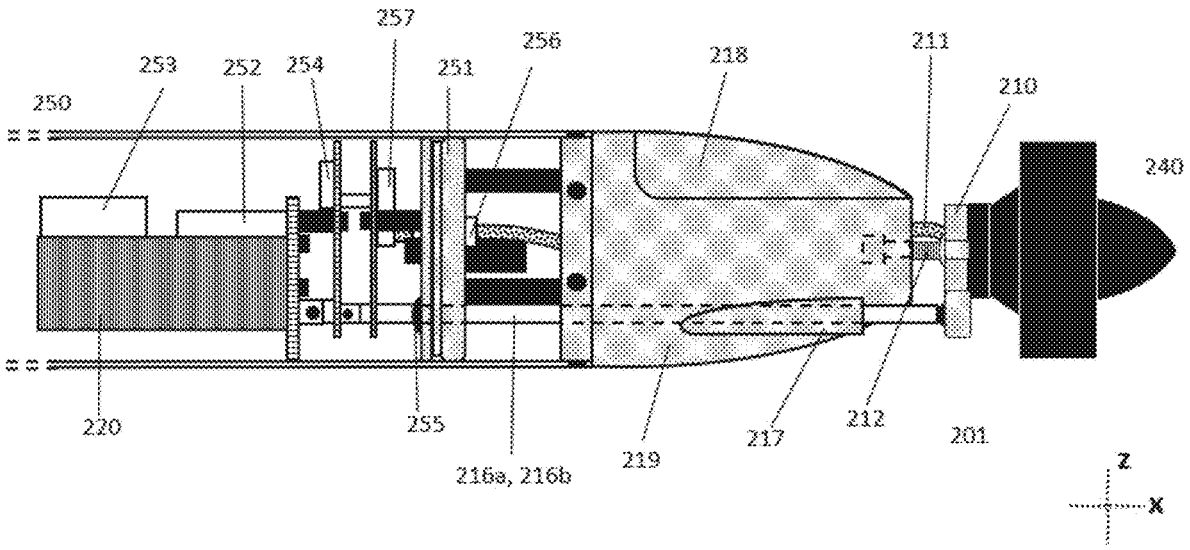
FIG. 2A is a side view of a thrust vectoring system in a submersible vehicle, according to example embodiments.

FIG. 2A is a side view 200*a* of a thrust vectoring system in a submersible vehicle according to example embodiments. The side view 200*a* is a port side view. A thrust vectoring system 201 may be part of a submersible vehicle. The thrust vectoring system 201 may be connected to, and extend into, a hull housing 250 of the submersible vehicle. As depicted in side view 200*a*, the main components of the thrust vectoring system 201 are an actuator unit 220, a pair of pushrods 216*a*, 216*b*, and a thruster 240. Side view 200*a* depicts a first pushrod 216*a* from the pair of pushrods 216*a*, 216*b*. The first pushrod 216*a* may be on the port side. The hull housing 250 is sealed from water (e.g., water proof) by a sealed bulkhead 251. As a result, the hull housing 250 may hold electric components. A variety of seals may be employed to ensure the vehicle is adequately waterproofed while at the same time permitting components to traverse the sealed bulkhead 251. These may include, for example, a shaft seal 255 and a sealed cable access 256.

The electric components may include a processing unit 252, a controller unit 253, a communication unit 254, and a power supply 257. The processing unit 252 may regulate operation of the entire submersible vehicle. The processing unit 252 may also integrate the operations of the thrust vectoring system 201 with other operational components of the submersible vehicle (e.g., buoyancy, navigation, sensors). The processing unit 252 may be part of a closed loop system, which allows the thrust vectoring system 201 to operate in response to sensed environmental and/or operational factors. These may include adjustments in response to a roll of the submersible vessel.

The controller unit 253 may control operation of the thrust vectoring system 201. More specifically, the controller unit 253 may provide instructions to the actuator unit 220. The controller unit 253 may receive instructions from the processing unit 252. The communication unit 254 may allow the submersible vehicle to receive and send signals for the purpose of communicating externally. The communication unit 254 may communicate with other submersible vehicles, a surface vehicle, a mother vessel, a docking port, satellites, aircraft, buoys, and/or a base station.

The power supply 257 may provide power to the entire submersible vehicle. In particular, the power supply 257 may provide power to the thruster 240 through a power line 211. The power line 211 may traverse the sealed bulkhead 251 through the sealed cable access 256. The power line 211 may also traverse a length of a system housing 219, and a swivel plate 210 in order to connect and provide power to the thruster 240. The system housing 219 may be large enough to accommodate the power line 211, which will have some slack to permit the thruster 240 to undertake angular movement without constraints.

The actuator unit 220 may be connected to the pair of pushrods 216*a*, 216*b*. Side view 200*a* depicts a first pushrod 216*a* connected to the actuator unit 220. The first pushrod 216*a* may traverse the sealed bulkhead 251 through a shaft seal 255. The first pushrod 216*a* may also traverse a length of the system housing 219 and connect to a swivel plate 210. The swivel plate 210 may be attached to the thruster 240. This configuration may allow the swivel plate 210 to control the orientation of the thruster 240.

A main structural support of the swivel plate 210 and the thruster 240 may be a stern swivel and support rod 212. The stern swivel and support rod 212 may be a robust support rod that keeps the swivel plate 210 fixed to the stern of the submersible vehicle, but permits angular movement by the swivel plate 210 and the attached thruster 240 through a constituent swivel bearing. The stern swivel and support rod 212 may be fixed to the system housing 219. This fixed configuration may be accomplished through a screw, adhesive, and/or as a constituent mechanical assembly.

The swivel plate 210 may include swivel bearings at the junctures with the stern swivel and support rod 212 and the pair of pushrods 216*a*, 216*b*. This may allow the swivel plate 210 to translate linear movement by the first pushrod 216*a* into an angular orientation. The use of three connection points to the thruster 240, via the swivel plate 210 with swivel bearings at each connection point, may provide increased flexibility and simplicity. This may allow the thrust vectoring system 201 to be more efficient and cost-effective. The size of the swivel bearings may vary dependent on the scale of the submersible vehicle to be outfitted. Use of custom swivel bearings or multiple stages of swivel bearings may provide increased maneuvering capability by increasing the maximum angle of orientation of the thruster 240.

The system housing 219 of the thrust vectoring system 101 may include an access panel 218 and pushrod supports 217. The access panel 218 may permit installation, maintenance, and repair of the thrust vectoring system 201. The pushrod support 217 may stabilize movement of the pair of pushrods 216*a*, 216*b*. The pushrod support 217 complements the flexible nature of the pair of pushrods 216*a*, 216*b*. The pair of pushrods 216*a*, 216*b* should have a very low friction (i.e., be slippery) in order to seamlessly move about each pushrod support 217.

Figure 2B:
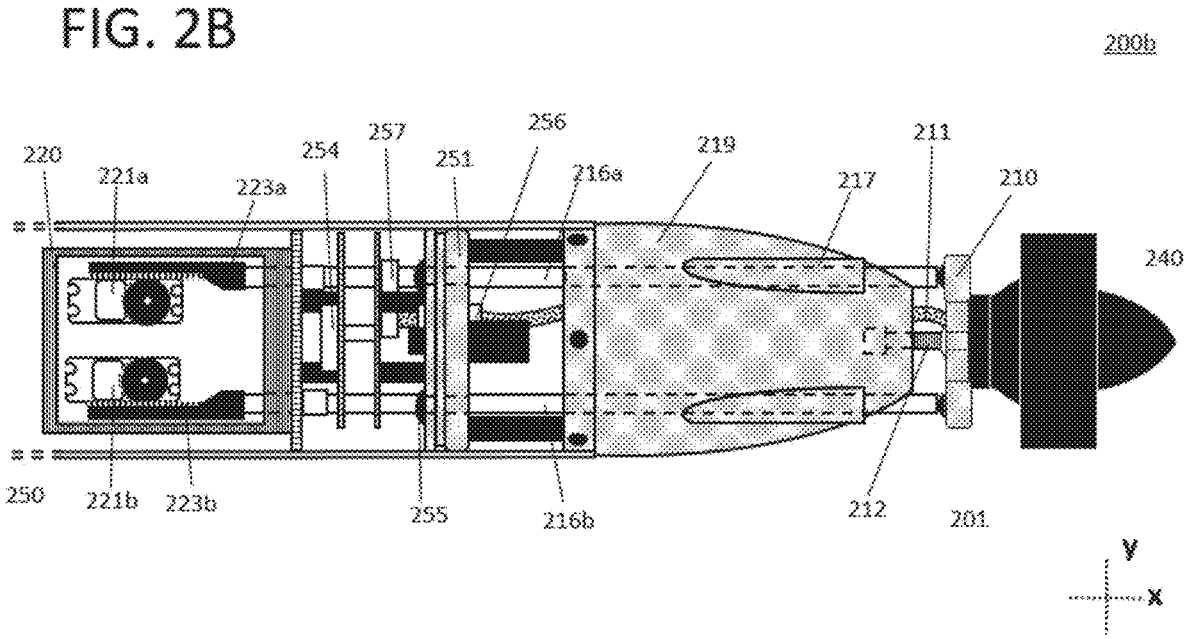
FIG. 2B is a bottom view of a thrust vectoring system in a submersible vehicle, according to example embodiments.

FIG. 2B is a bottom view 200*b* of a thrust vectoring system in a submersible vehicle according to example embodiments. The submersible vehicle may include a thrust vectoring system 201, which may be connected at one end to a hull housing 250 that is protected from water by a sealed bulkhead 251. At another end, the thrust vectoring system 201 may be connected to a thruster 240.

Like the previous figure, the thrust vectoring system 201 may comprise a swivel plate 210, a power line 211, a stern swivel and support rod 212, and a thrust vectoring system housing 219. The thrust vectoring system 201 may comprise various electric components. Illustrated from this view are a communication unit 254 and a power supply 257. The sealed bulkhead 251 of the system housing 219 may include a sealed cable access 256 and a pair of shaft seals 255 to prevent water from entering the hull housing 250.

The bottom view 200*b* of the thrust vectoring system 201 better illustrates a pair of pushrods, a first pushrod 216*a* and a second pushrod 216*b*, as well as pushrod supports 217 for each respective pushrod. Bottom view 200*b* also illustrates an example embodiment of the makeup of an actuator unit 220. The actuator unit 220 may be a linear actuator. The actuator unit 220 may be any servo or actuator that drives a sealable rod in and out of the submersible vehicle. Depicted in the illustration 200*b*, the actuator unit 220 may comprise a first servo with gear 221*a* paired with a first connecting rack 223*a*, and a second servo with gear 221*b* paired with a second connecting rack 223*b*.

The thruster 240 may be mounted on the swivel plate 210. The swivel plate 210 may hold three swivel bearings. A stern swivel bearing may be placed centered on the thruster 240 and may be connected to the stern of the submersible vehicle via the stern swivel and support rod 212. In some example embodiments, the stern swivel and support rod 212 may be in the form of a screw.

The other two swivel bearings, a first pushrod swivel bearing and a second pushrod swivel bearing, may each connect to the aft end of the first pushrod 216*a* and the second pushrod 216*b*. The connection of the two swivel bearings with the first pushrod 216*a* and the second pushrod 216*b* may be via a screw. The bearings may be captured via the connection, such that pushing in (in the forward direction) or out (in the aft direction) in any one of the pair of pushrods 216*a*, 216*b* causes an equidistant arc swing of the swivel plate 210.

The actuator unit 220 only requires two actuator components paired with the single thruster 240. These components may be, according to one example embodiment, the first servo with gear 221*a* paired with a first connecting rack 223*a*, and a second servo with gear 221*b* paired with a second connecting rack 223*b*. Rotation by the first servo with gear 221*a* may be translated to a linear force by the first connecting rack 223*a*. The same functionality may apply to the second servo with gear 221*b* and the second connecting rack 223*b*. Such a configuration may provide the necessary controls to operate the submersible vehicle at low and high speeds. This configuration is also a more simplified mechanical arrangement than conventional systems, reducing overall cost and complexity, and allowing the thrust vectoring system 201 to be scaled to significantly smaller applications.

Figure 3:
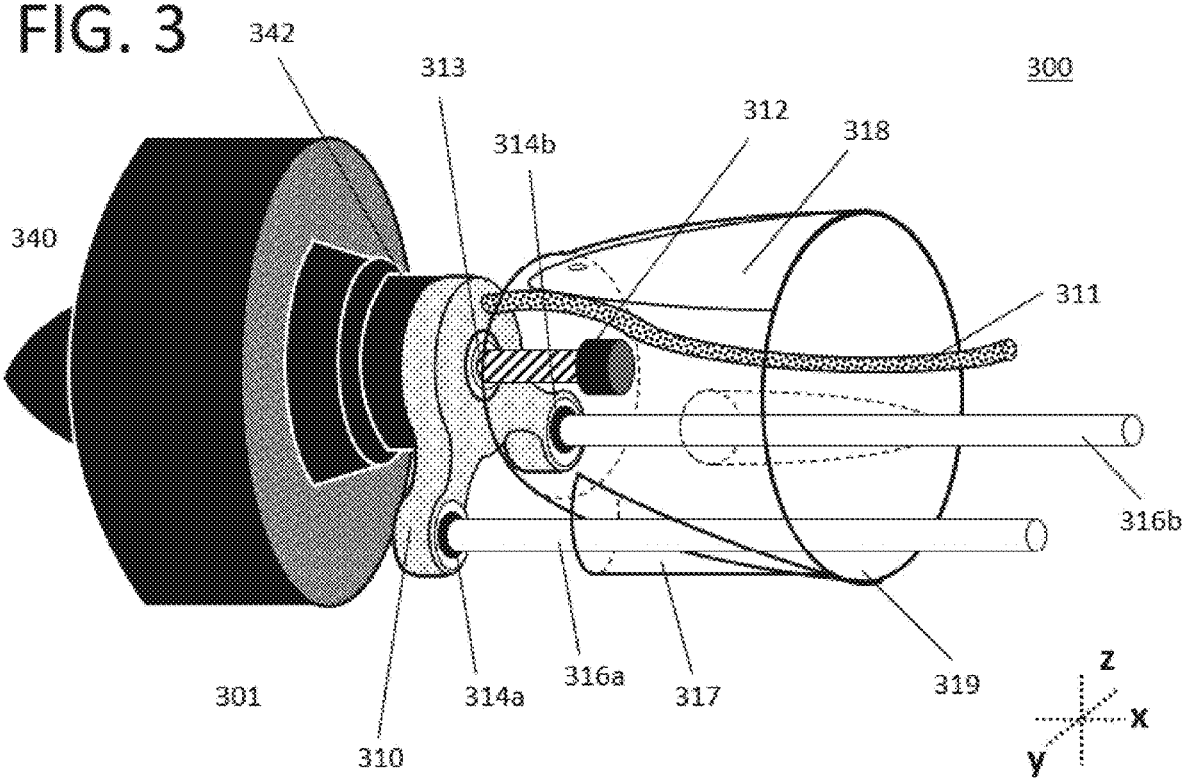
FIG. 3 is a three dimensional illustration of a thrust vectoring system, according to example embodiments.

FIG. 3 is a three dimensional illustration 300 of a thrust vectoring system according to example embodiments. A thrust vectoring system 301 may comprise a system housing 319 and a housing access panel 318. The system housing 319 may be located at the stern of a submersible vehicle. The system housing 319 may be made of any robust marine material. The system housing 319 may be a marine-grade plastic. More particularly, the housing may be a high-density polyethylene, marine-grade PVC foam material, marine-grade acrylic, and/or marine-grade polycarbonate. The system housing 319 may be made using convention methods and/or additive manufacturing methods. The system housing 319 may be made of the same material as the submersible vehicle's hull housing.

The system housing 319 may include a pair of pushrod supports 317. The pushrod supports 317 may be molded as part of the system housing 319. The pushrod supports 317 may support a pair of pushrods 316*a*, 316*b*. The system housing 319 may also hold a power line 311. At the base of the system housing 319 may be a stern swivel and support rod 312. The stern swivel and support rod 312 may be fixed to the system housing 319 or a structural component of the submersible vehicle (e.g., frame). The stern swivel and support rod 312 may be fixed via a screw, an adhesive, welding, and/or machining. The stern swivel and support rod 312 may be centrally located about the y-z plane of the stern of the submersible vehicle.

The thrust vectoring system 301 may also include a swivel plate 310. The swivel plate 310 may include a thruster connector 342. The thruster connector 342 may fix the swivel plate 310 to a thruster 340. The thruster 340 may be a specially designed thruster or a commercially available thruster (e.g., a blue Robotics T200 thruster).

The swivel plate 310 may be connected to the pair of pushrods 316*a*, 316*b* and the stern swivel and support rod 312. More specifically, the swivel plate 310 may be connected to the stern swivel and support rod 312 in a central location about the y-z plane. The junction of the swivel plate 310 and the stern swivel and support rod 312 may include a stern swivel bearing 313. The stern swivel bearing 313 may allow angular motion of the swivel plate 310.

The swivel plate 310 may be connected to a first pushrod 316*a*, with the junction comprising a first pushrod swivel bearing 314*a*. Similarly, the swivel plate 310 may be connected to a second pushrod 316*b*, with the junction comprising a second pushrod swivel bearing 314*b*. The first pushrod swivel bearing 314*a* and the second pushrod swivel bearing 314*b* may be offset equal distances, and such that the angle between the swivel bearing's centers is 90 degrees. The first pushrod swivel bearing 314*a*, the second pushrod swivel bearing 314*b*, and the stern swivel bearing 313 may be low-cost plastic swivel bearings.

The first pushrod swivel bearing 314*a* and the second pushrod swivel bearing 314*b* may be captured to the swivel plate 310. Pushing in or out any one of the pair of pushrods 316*a*, 316*b* may cause an equidistant arc swing of the swivel plate 310. This movement may adjust an orientation of the thruster 340. Accordingly, the thrust vectoring system 301 may allow up to ±34° of angular positioning of the thruster 340 in any direction from the nominal position shown. According to example embodiments, the thruster 340 may have full pitch and yaw flexibility.

In cases of undesired twist in roll, roll flexibility of the thruster 340 is minimized by supporting the pair of pushrods 316*a*, 316*b* as close as possible to their ends with the system housing 319. This may allow a negligible amount of roll flexure to occur. In alternative example embodiments, roll flexure may be addressed through the use of a fourth swivel bearing mounted to the swivel plate 310, as well as use of a corresponding third pushrod. This is discussed further in FIG. 6.

Figure 4:
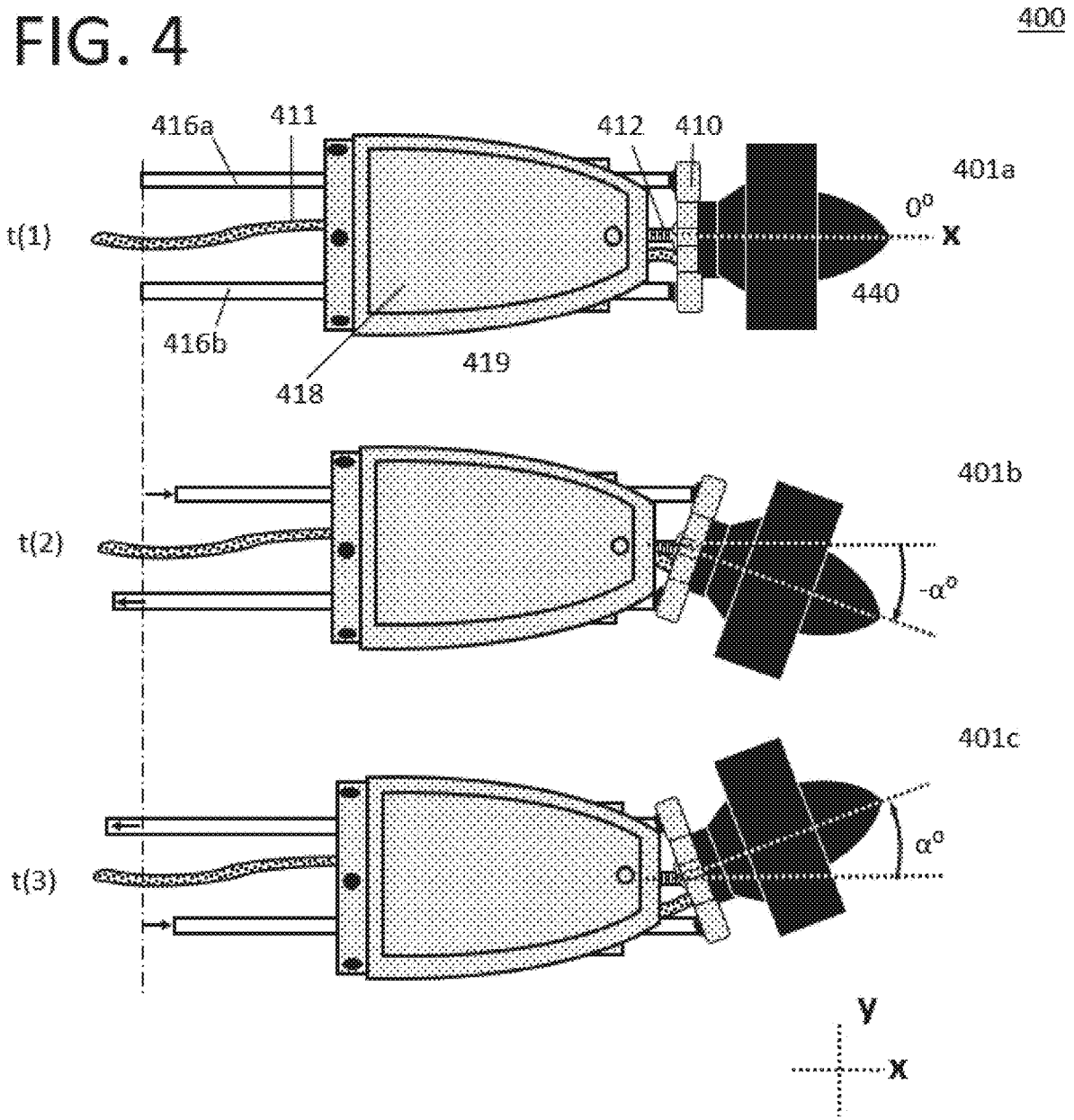
FIG. 4 is an illustration of yaw control configurations of a thrust vectoring system, according to example embodiments.

FIG. 4 is an illustration 400 of yaw control configurations of a thrust vectoring system according to example embodiments. The illustration 400 is about the x-y plane to illustrate yaw control. The illustration 400 depicts a thrust vectoring system at a first configuration 401*a*, a second configuration 401*b*, and a third configuration 401*c*. The thrust vectoring system may comprise a system housing 419, a housing access panel 418, a stern swivel and support rod 412, a power line 411, a swivel plate 410, a thruster 440, a first pushrod 416*a*, and a second pushrod 416*b*. The system housing 419 may be situated at the stern of a submersible vehicle.

The thrust vectoring system may be configured as previously discussed. The swivel plate 410 may have three swivel bearings connected to the stern swivel and support rod 412, the first pushrod 416*a*, and the second pushrod 416*a*, respectively. The stern swivel and support rod 412 may be fixed at the opposite end to the system housing 419 or a structural component of the submersible vehicle. The first pushrod 416*a*, and the second pushrod 416*b* may be connected to an actuator unit (not shown). The first pushrod 416*a* may be a starboard side pushrod, and the second pushrod 416*b* may be a port side pushrod.

The thrust vectoring system at a first configuration 401*a* is at a hypothetical time interval t(1). During time interval t(1), the first configuration 401*a* may be a baseline configuration with respect to yaw. The thruster 440 may be pointing in a straight direction in parallel with the submersible vehicle. In this configuration, the thruster 440 may be at a zero degree yaw angle about the x-axis.

At time interval t(2), the thrust vectoring system is at a second configuration 401*b* that permits port vectoring of the thruster 440. In this configuration, the actuator may cause the first pushrod 416*a* to move towards the swivel plate 410 (extended in the aft direction) and the second pushrod 416*b* to move away from the swivel plate 410 (retracted in the forward direction). In response, the swivel plate 410 may be pushed in the aft direction by the first pushrod 416*a*, and the pushed in the forward direction by the second pushrod 416*b*. The swivel plate 410 may be joined to the stern swivel and support rod 412, the first pushrod 416*a*, and the second pushrod 416*b* by three swivel bearings. As a result, the linear motion of the first pushrod 416*a* and the second pushrod 416*b* about the x-axis may be translated to a yaw angle of $-\alpha$ degrees. The second configuration 401*b* may translate to a port-turn position by the submersible vehicle.

Similarly, at a time interval t(3), the thrust vectoring system is at a third configuration 401*c* that permits starboard vectoring of the thruster 440. In this configuration, the actuator may retract the first pushrod 416*a* in the forward direction and extend the second pushrod 416*b* in the aft direction about the x-axis. At time interval t(3), the linear motion of the first pushrod 416*a* and the second pushrod 416*b* about the x-axis may be translated to a yaw angle of $\alpha$ degrees. The third configuration 401*c* may translate to a starboard-turn position by the submersible vehicle. It should be noted that the yaw angle may be greater or less than α and −α degrees, depending on the thrust vectoring system configuration.

Not depicted in illustration 400 is the flexible nature of the first pushrod 416*a* and the second pushrod 416*b*. During actuation, particularly at time intervals t(2) and t(3), the first pushrod 416*a* and the second pushrod 416*b* may flex to account for an offset associated with swinging the thruster 440 to a non-zero angle. This offset may be minor enough that the flexure of the pair of pushrods 416*a*, 416*b* does not compromise the seal or damage a respective one of the pair of pushrods 416*a*, 416*b* during operation. The three swivel bearings within the swivel plate 410 may provide the thrust vectoring system with the freedom to direct the thruster 440 to a specific position while sufficiently supporting the thruster 440 during operation. The flexible nature of the pair of pushrods 416*a*, 416*b* may be complemented by the stern swivel and support rod 412 and the swivel bearings, in order to allow for a location offset of the support points of the thruster 440 when the thruster 440 is positioned at an angle.

Figure 5:
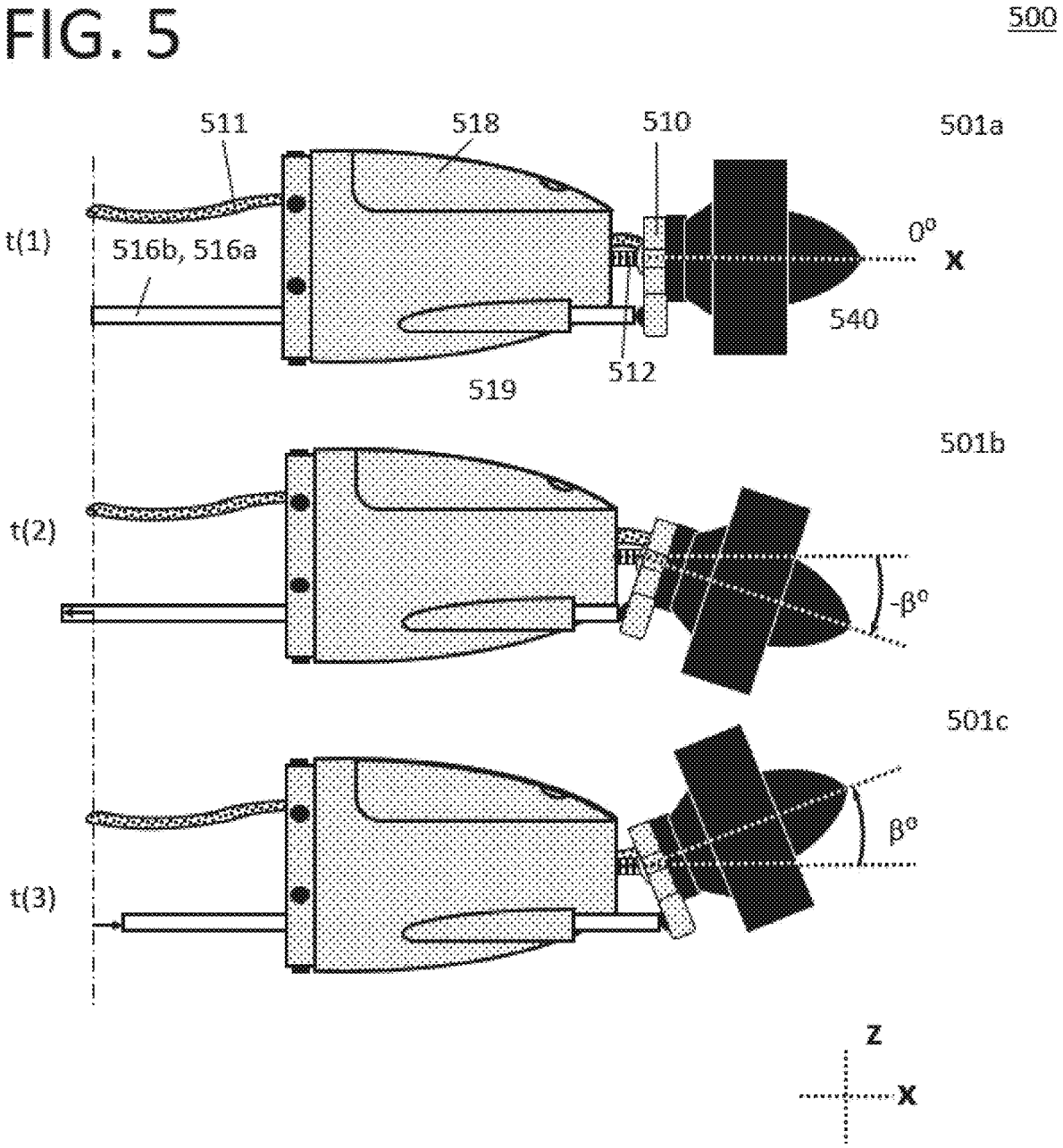
FIG. 5 is an illustration of pitch control configurations of a thrust vectoring system, according to example embodiments.

FIG. 5 is an illustration 500 of pitch control configurations of a thrust vectoring system according to example embodiments. The illustration 500 is about the x-z plane to illustrate pitch control. The illustration 500 depicts a thrust vectoring system at a first configuration 501*a*, a second configuration 501*b*, and a third configuration 501*c*. The thrust vectoring system may comprise a system housing 519, a housing access panel 518, a stern swivel and support rod 512, a power line 511, a swivel plate 510, a thruster 540, and a pair of pushrods 516*a*, 516*b*. The system housing 519 may be situated at the stern of a submersible vehicle. Because of the perspective, only the port side of the pair of pushrods 516*a*, 516*b* is visible in the illustration 500—more specifically a second pushrod 516*b*.

The thrust vectoring system may be configured as previously discussed. The swivel plate 510 may have three swivel bearings connected to the stern swivel and support rod 512 and the pair of pushrods 516*a*, 516*b*, respectively. The stern swivel and support rod 512 may be fixed at the opposite end to the system housing 519 or a structural component of the submersible vehicle. The first pushrod 516*a*, and the second pushrod 516*b* may be connected to an actuator unit (not shown). The pair of pushrods 516*a*, 516*b* may comprise a first pushrod 516*a* on a starboard side, and a second pushrod 516*b* on a port side pushrod. Because of the perspective, only the second pushrod 516*b* is visible from the port side.

The thrust vectoring system at a first configuration 501*a* is at a hypothetical time interval t(1). During time interval t(1), the first configuration 501*a* may be a baseline configuration with respect to pitch. The thruster 540 may be pointing in a straight direction in parallel with the submersible vehicle. In this configuration, the thruster 540 may be at a zero degree pitch angle about the x-axis.

At time interval t(2), the thrust vectoring system is at a second configuration 501*b* that permits dive vectoring of the thruster 540. In this configuration, the actuator may retract the pair of pushrods 516*a*, 516*b* in the forward direction. In response, the bottom of swivel plate 510 may be pushed in the aft by the pair of pushrods 516*a*, 516*b*. The swivel plate 510 may be joined to the stern swivel and support rod 512 and the pair of pushrods 516*a*, 516*b* by three swivel bearings. As a result, the linear motion of the pair of pushrods 516*a*, 516*b* about the x-axis may be translated to a pitch angle of −β degrees. The second configuration 501*b* may translate to a dive position by the submersible vehicle.

At a time interval t(3), the thrust vectoring system is at a third configuration 501*c* that permits rise vectoring of the thruster 540. In this configuration, the actuator may extend the pair of pushrods 516*a*, 516*b* in the aft direction about the x-axis. The linear motion of the pair of pushrods 516*a*, 516*b* about the x-axis may be translated to a pitch angle of β degrees. The third configuration 501*c* may translate to a rise position by the submersible vehicle.

FIG. 5 and FIG. 4 illustrate pitch directional control and yaw directional control, respectively. Pairing the yaw control configurations of FIG. 4 with the pitch control configurations of FIG. 5 may facilitate a range of motions by a thruster about an imaginary conical bounding box. This may allow overall directional control and highly effective maneuverability of a submersible vehicle. Combined, a thrust vectoring system according to example embodiments may vector the thrust of a submersible vehicle in a number of directions. These may include, dive, rise, port, and starboard vectoring.

Figure 6:
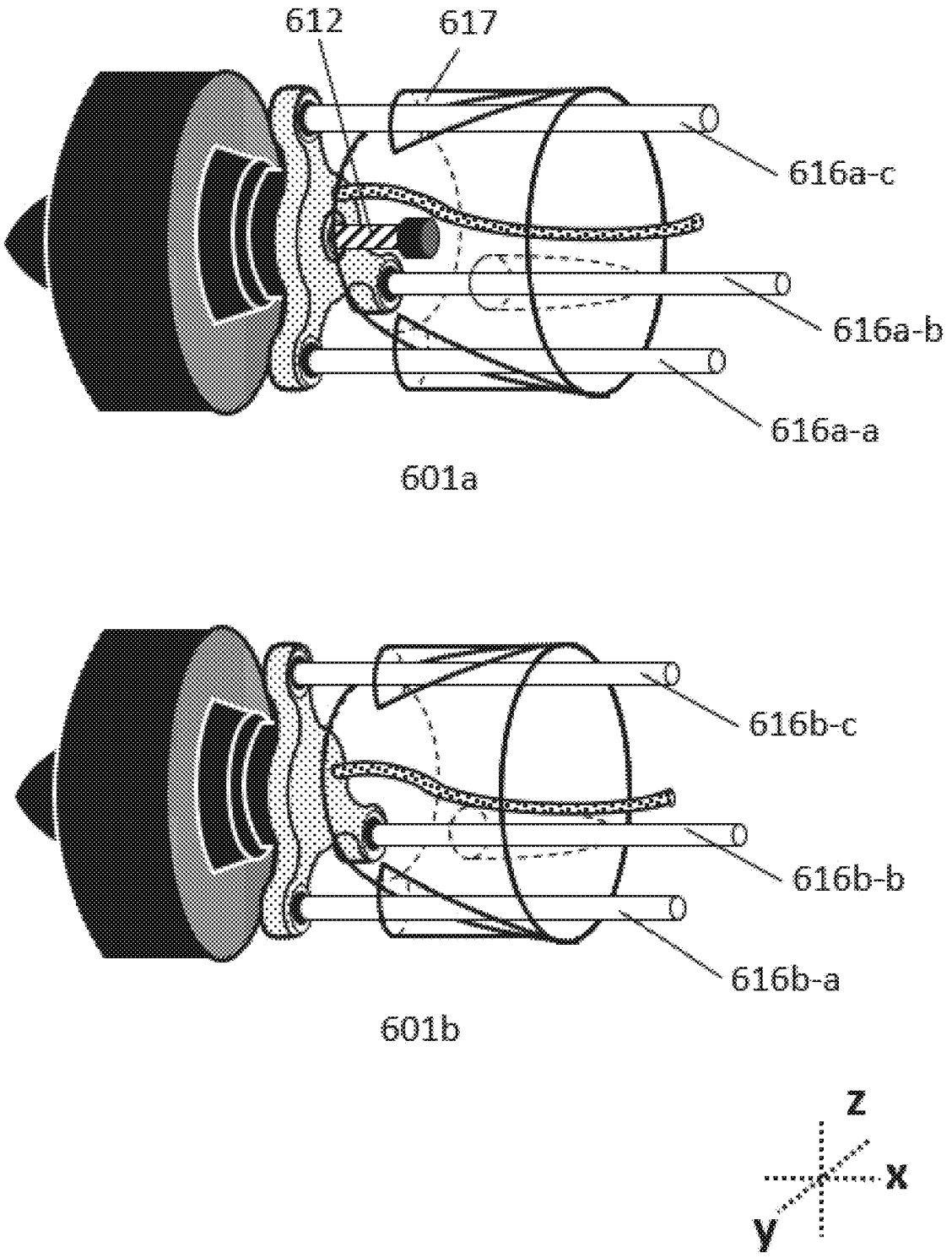
FIG. 6 is illustration of alternative thrust vectoring systems, according to example embodiments.

FIG. 6 is illustration 600 of alternative thrust vectoring systems, according to example embodiments. In alternative example embodiments, a third pushrod may be employed. The third pushrod may be associated with a same actuator unit as the other pushrods or a separate and dedicated actuator unit. More granularly, the actuator unit may be a separate servo with gear and connecting rack coupling. Such an alternative example embodiment may be employed in conjunction with or in lieu of a stern swivel and support rod.

A first alternative thrust vectoring system 601*a* may include three pushrods. These may comprise a first pushrod 616*a-a*, a second pushrod 616*a-b*, and a third pushrod 616*a-c*. Each of the three pushrods may be supported by an associated pushrod support 617. Notably, a stern swivel and support rod 612 may still provide structural support to a swivel plate.

A second alternative thrust vectoring system 601*b* may have the same configuration of three pushrods, which include a first pushrod 616*b-a*, a second pushrod 616*b-b*, and a third pushrod 616*b-c*. However, the second alternative thrust vectoring system 601*b* removes the stern swivel and support rod. Removal of the stern swivel and support rod may allow more degrees of freedom and greater maneuvering capabilities.

The example embodiments being thus described, it will be obvious that the same may be varied in many ways. Such variations are not to be regarded as a departure from the disclosed subject matter, and all such modifications are intended to be included within the scope of the disclosed subject matter.

What is claimed is:

1. A submersible thrust vectoring apparatus comprising:

a swivel plate with a first bearing and a second bearing, the swivel plate configured to have angular movement about an axis;

a thruster connected to the swivel plate, the thruster configured to move in the angular movement about the axis alongside the swivel plate, the thruster configured to generate thrust;

a first pushrod and a second pushrod connected at a first end to the first bearing and the second bearing, respectively, each of the first pushrod and the second pushrod configured to extend in an aft direction or retract in a forward direction in response to an actuated force; and an actuator unit connected to a second end of the first pushrod and the second pushrod, the actuator unit configured to provide the actuated force to the first pushrod and the second pushrod, wherein the angular movement of the swivel plate is in response to the actuated force from at least one of the first pushrod and the second pushrod, wherein the first bearing and the second bearing allow the swivel plate to remain joined to the first pushrod and the second pushrod when the actuated force causes the first pushrod and the second pushrod to extend in either the aft direction or retract in the forward direction in response to an actuated force, allowing the thruster and the swivel plate a range of angular motion defined by a conical bounding box.

2. The submersible thrust vectoring apparatus of claim 1, further comprising:

an apparatus housing unit configured to house at least a portion of the first pushrod and a portion of the second pushrod, and the actuator unit, the apparatus housing unit including a pushrod support for each of the first pushrod and the second pushrod;

a power line within the apparatus housing unit and extending to the thruster, the power line configured to provide power to the thruster; and a housing access panel configured to permit at least one of installation, maintenance, and repair of the thrust vectoring apparatus.

3. The submersible thrust vectoring apparatus of claim 2, further comprising:

a swivel and support rod fixed at one end to at least one of the apparatus housing unit or a structural component within the apparatus housing unit, the swivel and support rod connected at another end to a stern swivel bearing in the swivel plate, the stern swivel bearing being located in a center of the swivel plate, the swivel and support rod configured to provide structural support to the swivel plate and the thruster during the angular movement.

4. The submersible thrust vectoring apparatus of claim 2, further comprising:

a sealed bulkhead at an end of the apparatus housing unit that is opposite to a location of the swivel plate and the thruster, the sealed bulkhead configured to facilitate a waterproof environment at an adjacent hull housing;

a first shaft seal and a second shaft seal attached to the first pushrod and the second pushrod, respectively, the first shaft seal and the second shaft seal facilitating motion of the first pushrod and the second pushrod across the sealed bulkhead while maintaining the waterproof environment in the adjacent hull housing, a sealed cable access attached to the power line and configured to allow the power to traverse the sealed bulkhead and connect to a power supply in the adjacent hull housing.

5. The submersible thrust vectoring apparatus of claim 1, wherein the actuator unit comprises a first actuator connected to the first pushrod and a second actuator connected to the second pushrod, wherein at least one of the first actuator and the second actuator generates the actuated force.

6. The submersible thrust vectoring apparatus of claim 4, wherein the first actuator is a first servo unit a paired with a first connecting rack, and the second actuator is a second servo unit paired with a second connecting rack, wherein the first connecting rack is directly attached to the first pushrod and the second connecting rack is directly attached to the second pushrod, wherein a rotation by at least one of the first servo unit and the second servo unit is translated to the actuated force by at least one of the first connecting rack and the second connecting rack, respectively, and wherein the first servo unit and the second servo unit each comprise a servo and a gear.

7. The submersible thrust vectoring apparatus of claim 1, wherein the actuator unit is configured to generate an actuated force to correspond with a yaw control configuration, a pitch control configuration, and a combination therefor, in order to generate the range of angular motion defined by the conical bounding box.

8. The submersible thrust vectoring apparatus of claim 7, the yaw control configuration comprising:

a port vectoring configuration comprising extending the first pushrod in the aft direction and retracting the second pushrod in the forward direction, such that the swivel plate and thruster move at a negative yaw angle relative to the axis; and a starboard vectoring configuration comprising retracting the first pushrod in the forward direction and extending the second pushrod in the aft direction, such that the swivel plate and thruster move at a positive yaw angle relative to the axis, wherein the first pushrod is in the starboard side and a second pushrod is in the port side.

9. The submersible thrust vectoring apparatus of claim 7, the pitch control configuration comprising:

a dive vectoring configuration comprising retracting in the forward direction the first pushrod and the second pushrod, such that the swivel plate and thruster move at a negative pitch angle relative to the axis; and a rise vectoring configuration comprising extending in the aft direction the first pushrod and the second pushrod, such that the swivel plate and thruster move at a positive pitch angle relative to the axis.

10. The submersible thrust vectoring apparatus of claim 7, wherein the first pushrod and the second pushrod are made up of a flexible material, such that the first pushrod and the second pushrod are configured to flex in response to an offset associated with a swinging motion by the swivel plate and the thruster to a non-zero angle.

11. The submersible thrust vectoring apparatus of claim 10, wherein the flexible material is at least one of acetyl, stainless steel, bronze, anodized aluminum, and nylon.

12. The submersible thrust vectoring apparatus of claim 10, further comprising:

a third pushrod, such that the third pushrod is connected at a first end to a third bearing in the swivel plate, the third pushrod being centrally located in the swivel plate, the third pushrod being connected at a second end to the actuator unit, wherein the third pushrod is configured extend in an aft direction or retract in a forward direction in response to the actuated force, the actuator unit configured to provide the actuated force to the third pushrod.

13. A submersible vehicle apparatus comprising:

a hull housing configured to house at least electric components;

a thrust vectoring apparatus to determine orientation of the submersible vehicle apparatus, the thrust vectoring apparatus comprising, a swivel plate with a first bearing and a second bearing, the swivel plate configured to have angular movement about an axis;

a thruster connected to the swivel plate, the thruster configured to move in the angular movement about the axis alongside the swivel plate, the thruster configured to generate thrust;

a first pushrod and a second pushrod connected at a first end to the first bearing and the second bearing, respectively, each of the first pushrod and the second pushrod configured to extend in an aft direction or retract in a forward direction in response to an actuated force; and an actuator unit connected to a second end of the first pushrod and the second pushrod, the actuator unit configured to provide the actuated force to the first pushrod and the second pushrod, wherein the angular movement of the swivel plate is in response to the actuated force from at least one of the first pushrod and the second pushrod, wherein the first bearing and the second bearing allow the swivel plate to remain joined to the first pushrod and the second pushrod when the actuated force causes the first pushrod and the second pushrod to extend in either the aft direction or retract in the forward direction in response to an actuated force, allowing the thruster and swivel plate a range of angular motion defined by a conical bounding box.

14. The submersible vehicle apparatus of claim 13, the electric components comprising a processing unit configured to regulate operation the entire submersible vehicle, including at least buoyancy, navigation, and sensing;

a controller unit configured to at least control operation of the thrust vectoring system;

a communication unit configure to at least receive and send signals; and a power supply configured to provide power to the thruster through a power line.

15. The submersible vehicle apparatus of claim 13, the thrust vectoring apparatus further comprising:

an apparatus housing unit configured to house at least a portion of the first pushrod and a portion of the second pushrod, and the actuator unit, the apparatus housing unit including pushrod supports for the first pushrod and the second pushrod;

a power line within the apparatus housing unit and extending to the thruster, the power line configured to provide power to the thruster; and a housing access panel configured to permit at least one of installation, maintenance, and repair of the thrust vectoring apparatus.

16. The submersible thrust vectoring apparatus of claim 15, further comprising:

a swivel and support rod fixed at one end to at least one of the apparatus housing unit or a structural component within the apparatus housing unit, the swivel and support rod connected at another end to a third bearing in the swivel plate, the third bearing being located in a center of the swivel plate, the swivel and support rod configured to provide structural support to the swivel plate and the thruster during the angular movement.

17. The submersible thrust vectoring apparatus of claim 16, further comprising:

a sealed bulkhead at an end of the apparatus housing unit that is opposite to a location of the swivel plate and the thruster, the sealed bulkhead configured to facilitate a waterproof environment at the hull housing, the hull housing being adjacent;

a first shaft seal and a second shaft seal attached to the first pushrod and the second pushrod, respectively, the first shaft seal and the second shaft seal facilitating motion of the first pushrod and the second pushrod across the sealed bulkhead while maintaining the waterproof environment in the hull housing, a sealed cable access attached to the power line and configured to allow the power to traverse the sealed bulkhead and connect to the power supply in the hull housing.

* * * * *